US008215225B1

(12) United States Patent
Zangrando et al.

(10) Patent No.: US 8,215,225 B1
(45) Date of Patent: Jul. 10, 2012

(54) LARGE CALIBER AUTOLOADER

(75) Inventors: Roy Zangrando, Boonton, NJ (US); William Burgermeister, Freehold, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 184 days.

(21) Appl. No.: 12/792,829

(22) Filed: Jun. 3, 2010

(51) Int. Cl.
*F41A 9/00* (2006.01)

(52) U.S. Cl. ..... 89/46; 89/45; 89/33.01; 89/33.03; 89/33.05; 89/33.1

(58) Field of Classification Search ..... 89/46, 45, 89/33.01, 33.03, 33.05, 33.1
See application file for complete search history.

(56) References Cited

U.S. PATENT DOCUMENTS

| | | | | | |
|---|---|---|---|---|---|
| 2,649,840 | A * | 8/1953 | Davidson, Jr. | ..... | 89/33.16 |
| 3,724,324 | A * | 4/1973 | Zielinski | ..... | 89/36.13 |
| 4,092,900 | A * | 6/1978 | Hottinger et al. | ..... | 89/33.1 |
| 4,381,693 | A * | 5/1983 | Dumez | ..... | 89/36.13 |
| 4,388,854 | A * | 6/1983 | Dabrowski et al. | ..... | 89/46 |
| 4,429,616 | A * | 2/1984 | Grosser | ..... | 89/36.13 |
| 4,640,181 | A * | 2/1987 | Schiele et al. | ..... | 89/46 |
| 4,690,031 | A * | 9/1987 | Metz et al. | ..... | 89/36.13 |
| 4,727,790 | A * | 3/1988 | DeHaven et al. | ..... | 89/46 |
| 4,777,863 | A * | 10/1988 | De Haven et al. | ..... | 89/33.1 |
| 4,823,676 | A * | 4/1989 | Wiethoff et al. | ..... | 89/46 |
| 4,991,489 | A * | 2/1991 | Lindberg | ..... | 89/6.5 |
| 5,223,663 | A * | 6/1993 | Bender-Zanoni et al. | ..... | 89/46 |
| 5,440,966 | A * | 8/1995 | Tellander et al. | ..... | 89/46 |
| 5,594,194 | A * | 1/1997 | Steward et al. | ..... | 89/46 |
| 5,756,923 | A * | 5/1998 | Golden et al. | ..... | 89/46 |
| 5,965,837 | A * | 10/1999 | Lee et al. | ..... | 89/46 |
| 6,460,448 | B1 * | 10/2002 | Zangrando | ..... | 89/45 |
| 6,679,159 | B1 * | 1/2004 | Hullett | ..... | 89/45 |
| 6,752,063 | B2 * | 6/2004 | Panek et al. | ..... | 89/46 |
| 6,772,669 | B1 * | 8/2004 | Stalhandske et al. | ..... | 89/47 |
| 2002/0144590 | A1 * | 10/2002 | Grange et al. | ..... | 89/46 |

* cited by examiner

*Primary Examiner* — Michael Carone
*Assistant Examiner* — Samir Abdosh
(74) *Attorney, Agent, or Firm* — Michael C. Sachs

(57) ABSTRACT

An air, land, or sea vehicle may include a gun and a rotatable turret ring. An autoloader may be disposed in a basket fixed to the turret ring. The autoloader may include a turntable that rotates independently of the turret ring. An elevator having a track may rotate with the turntable. A carriage may be linearly translatable on the track of the elevator in directions toward and away from the plane of the turntable. A transfer device may be rotatably fixed to a pivot of the carriage. The transfer device may include a rail and a gripper that is linearly translatable on the rail.

14 Claims, 9 Drawing Sheets

LARGE CALIBER AUTOLOADER

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to the handling of large caliber ammunition, for example, ammunition larger than 40 mm caliber.

A large diameter bearing (turret ring) may be mounted on the deck of a combat vehicle. A turret structure, including a gun, may be horizontally rotatable with the turret ring. A basket may also be mounted on the turret ring. The basket may extend downwardly into the vehicle hull. The basket may rotate with the turret ring and the gun. The basket may carry items incident to gun operations.

Large caliber guns were traditionally loaded by hand. Many autoloaders have been designed and built, each having varying configurations and characteristics. Known autoloaders may require that the gun be moved to a particular azimuth and elevation (usually 0 degrees azimuth and about 0 degrees elevation) to be loaded. So, the gun may be required to go "off target" for loading. Moving a large caliber gun may take significant time, especially moving in the azimuth, because the entire turret may be rotating. Also, in some tank configurations, moving the gun may also move the sight off target, because many sights may have limited azimuth in relation to the turret position.

Other known autoloaders may have several "ready rounds" in the turret, with a larger supply of rounds in the tank chassis. Only the "ready rounds" may be loaded at any azimuth, and usually a fixed elevation. The "ready rounds" add to the weight of the rotating turret.

A need exists for an autoloader that may allow loading at any azimuth of the gun, and a fixed elevation, for all available rounds, without adding significant weight to the turret.

SUMMARY OF THE INVENTION

It is an object of the invention to provide a large caliber autoloader that may load a gun at any azimuth.

One aspect of the invention is an autoloader having a rotatable turntable and an elevator that rotates with the turntable. The elevator may include a track. A carriage may be linearly translatable on the track of the elevator in directions toward and away from a plane of the turntable. A transfer device may be rotatably fixed to a pivot of the carriage. The transfer device may include a rail and a gripper that is linearly translatable on the rail.

Another aspect of the invention is an apparatus that includes a vehicle hull having a rotatable turret ring. A basket may be suspended from and rotate with the turret ring. An autoloader may be disposed in the basket. The turntable of the autoloader may rotate independent of the turret ring. An ammunition magazine may be disposed in the vehicle hull. The ammunition magazine may include an access port.

A further aspect of the invention is an autoloader having a rotatable turntable. A base may be fixed to and rotatable with the turntable. A crank case may be rotatably fixed to the base. A yoke may be rotatably fixed to the crank case. A transfer device may be rotatably fixed to the yoke. The transfer device may include a rail and a gripper that is linearly translatable on the rail.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

An automatic loader may provide a means to automatically transfer ammunition from a hull-mounted magazine to a chamber of a large caliber gun, and may also provide a means to automatically transfer ammunition from the chamber of the gun back to the magazine. An automatic loader may provide a means to easily upload ammunition to the magazine from an ammunition supply source. An automatic loader may provide a means to dispose of a spent cartridge case. An automatic loader may minimize the volume swept by the automatic loader during operation.

An automatic loader for large caliber ammunition may include a transfer device mounted on an elevating and positioning device. The transfer device may be rotatable within a turret basket by means of a turntable. The turntable may rotate independently of the basket to multiple positions. The automatic loader may perform one or more of the following functions, among others: retrieve ammunition from an active magazine in the hull; align the ammunition with a cannon position; load the ammunition into the cannon; download the ammunition out of the cannon; retract to a stowed position during firing of the cannon; catch a spent cartridge case; eject the spent cartridge case from the vehicle; and transfer ammunition from an external ammunition supply to a magazine located on a vehicle with the automatic loader.

The loading of ammunition into the cannon and the downloading of ammunition out of the cannon may occur at any turret azimuth angle. The loading of ammunition into the cannon and the downloading of ammunition out of the cannon may occur at a fixed elevation angle of the cannon or gun.

Figure 1:
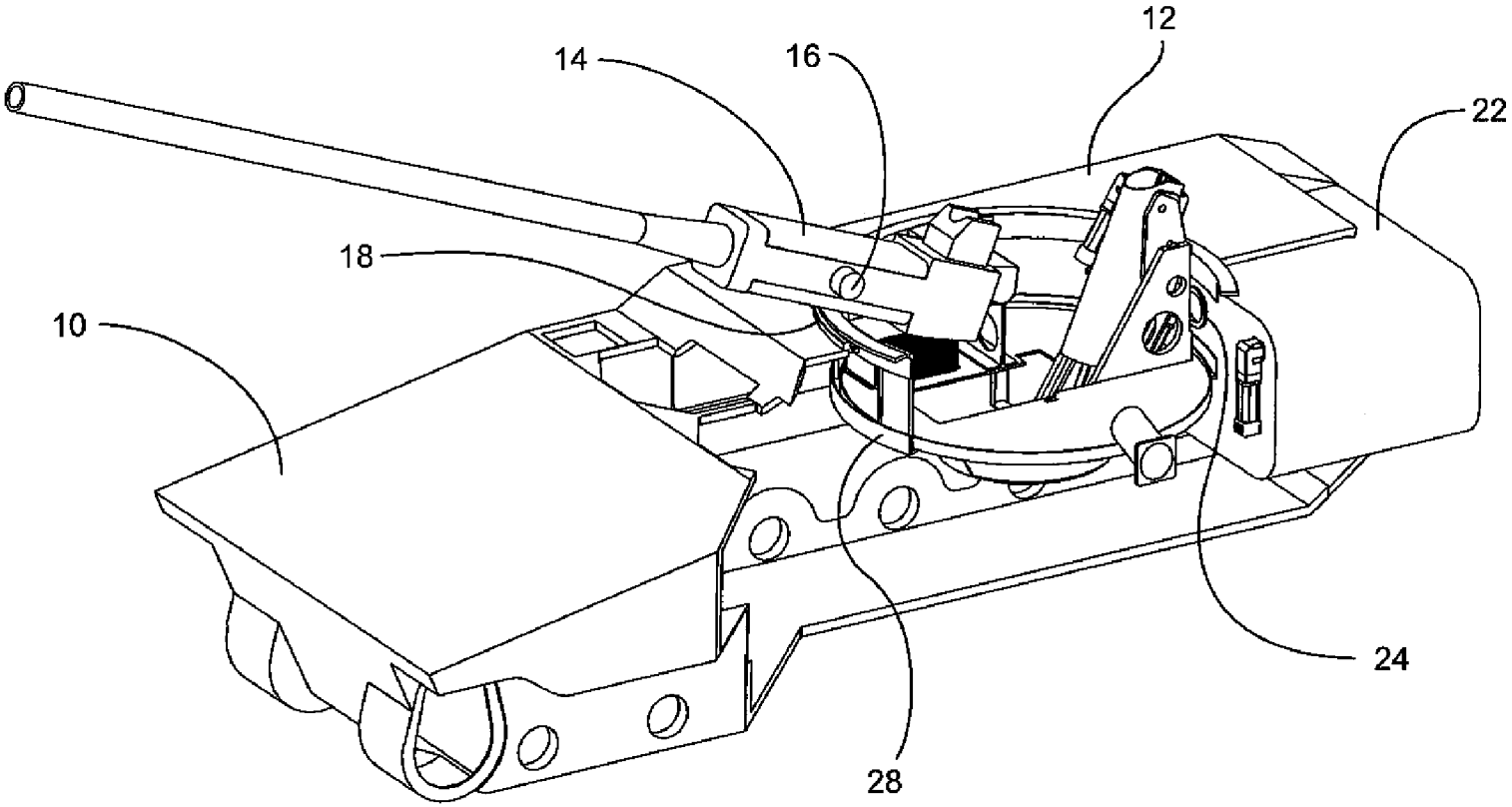
FIG. 1 is a partially cutaway, perspective view of an exemplary vehicle hull and an embodiment of an automatic loader. The complete turret structure is not shown.

FIG. 1 shows an exemplary vehicle body or hull 10 and an embodiment of an automatic loader 12. Vehicle hull 10 may be the hull of a land, sea, or air vehicle, or another type of structure that may use an automatic loader 12 for moving objects, for example, ammunition cartridges.

A gun 14 may be mounted to a turret structure (the entire turret structure is not shown) via trunnions 16. The elevation of gun 14 may be varied by rotation about trunnions 16. The turret structure may include a turret ring 18 that may be mounted to the deck of the hull 10. The turret ring 18 may be horizontally rotatable with respect to the hull 10 to thereby point the gun 14. The turret structure may include a basket 28 that may rotate with the gun 14 and the turret ring 18.

An automatic loader 12 in accordance with the invention may be mounted in the basket 28. The automatic loader 12 may retrieve ammunition from a magazine 22. Magazine 22 may be integral to the hull 10. The magazine 22 may be an active type of magazine which internally positions the ammunition as required for retrieval at a magazine port 24.

Figure 2:
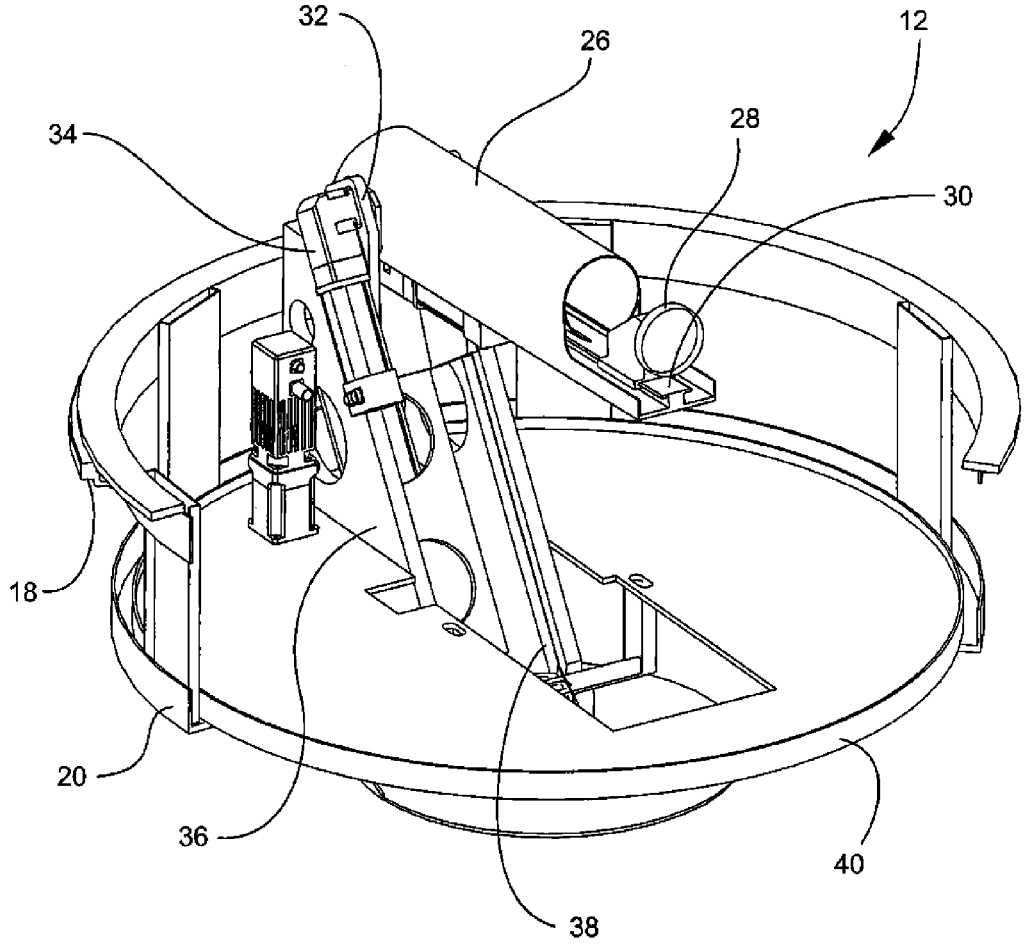
FIG. 2 is a partially cutaway, perspective view of an embodiment of an automatic loader showing its major functional components.

Referring now to FIG. 2, the automatic loader 12 may include a transfer device 26 having a gripper 28. Gripper 28 may be slidable on rail 30. The transfer device 26 may be mounted on a carriage 32 and may rotate vertically on the carriage 32. A servomotor 34 may power the vertical rotation of the transfer device 26. The carriage 32 may move linearly on an elevator 36. The carriage 32 may be guided by tracks 38 on the elevator 36. Autoloader 12 may include a turntable 40 that rotates concentric with, but independently of, the basket 20. The elevator 36 may rotate with the turntable 40.

Figure 3:
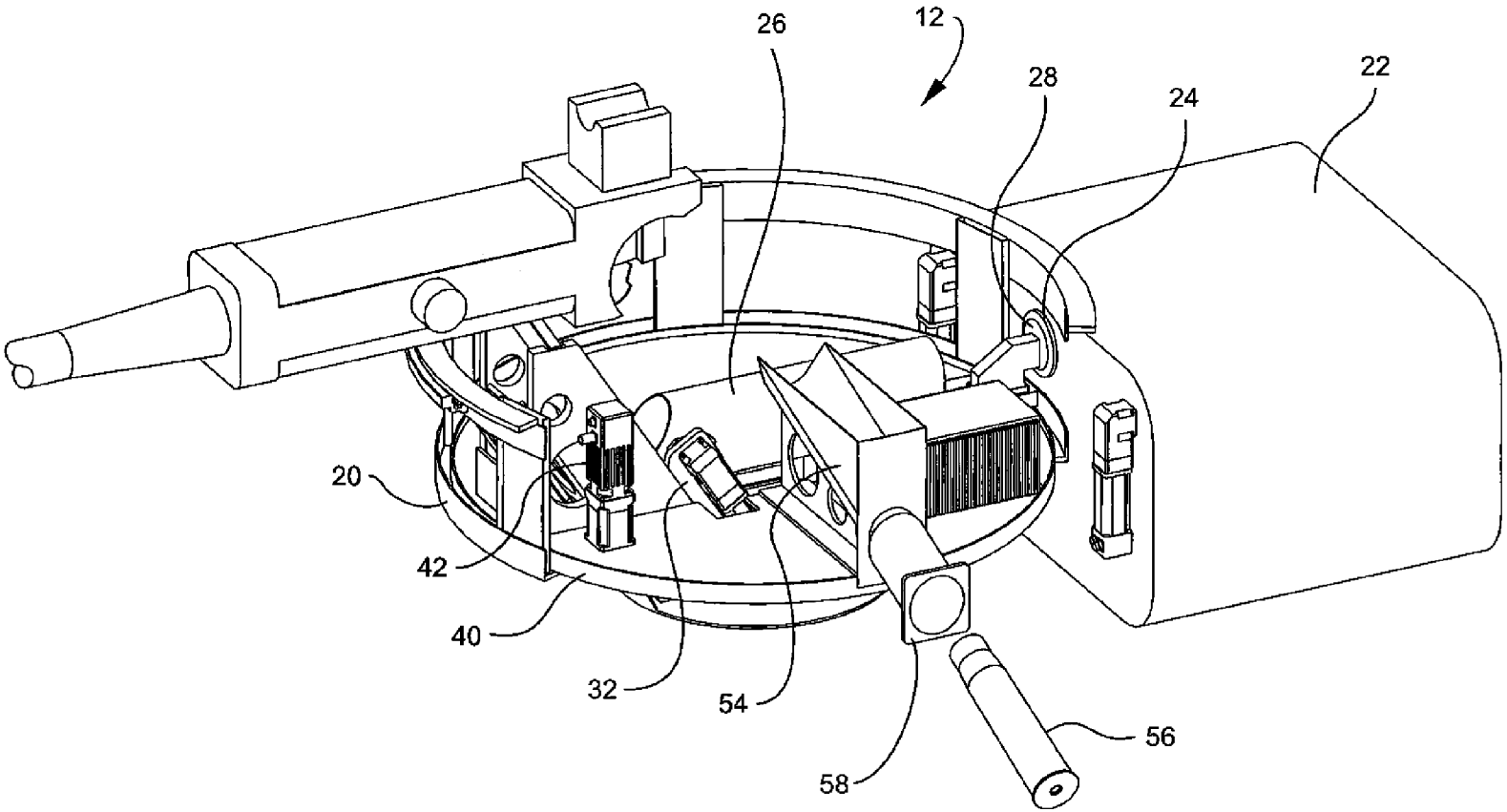
FIG. 3 is a partially cutaway, perspective view of an embodiment of an automatic loader in the re-arm position.

FIG. 3 shows the autoloader 12 in a re-arm position. Here, the turntable 40 has been rotated within the basket 20 by a motor 42, to align the transfer device 26 with the magazine port 24. Thereupon the gripper 28 advances into the magazine port 24, captures a round of ammunition, and withdraws it into the transfer device 26.

Figure 4:
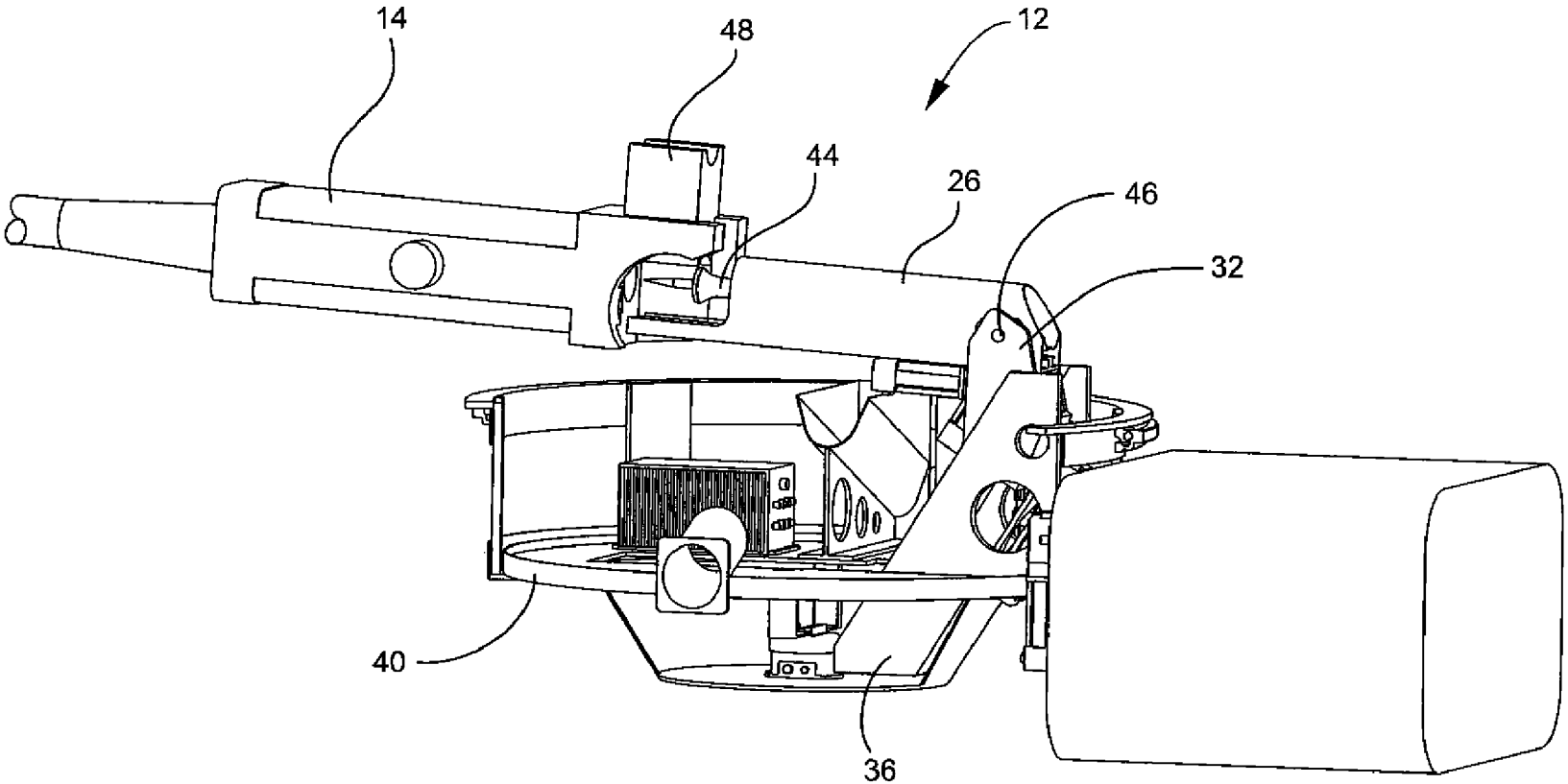
FIG. 4 is a partially cutaway, perspective view of an embodiment of an automatic loader in the load position.

FIG. 4 shows the autoloader 12 in a load position. The turntable 40 has rotated from the re-arm position to horizontally align the transfer device 26 with the plane of the gun 14. The transfer device 26 may carry an ammunition round 44. The transfer device 26 may be vertically raised by carriage 32 on elevator 36. The transfer device 26 may also vertically rotate around a pivot 46 to align the round 44 with the bore of the gun 14. Then, the gripper 28 (not shown in FIG. 4) may advance the round 44 into the gun 14. The gripper 28 may then release the round 44. Gripper 28 may stop its forward motion prior to reaching the breech 48 of the gun 14 to thereby allow the round 44 to continue into the gun 14 by its own inertia. The breech 48 may then be closed without interference. After aiming and firing, the gun 14 may be returned to the same elevation for loading via the autoloader 12.

Figure 5:
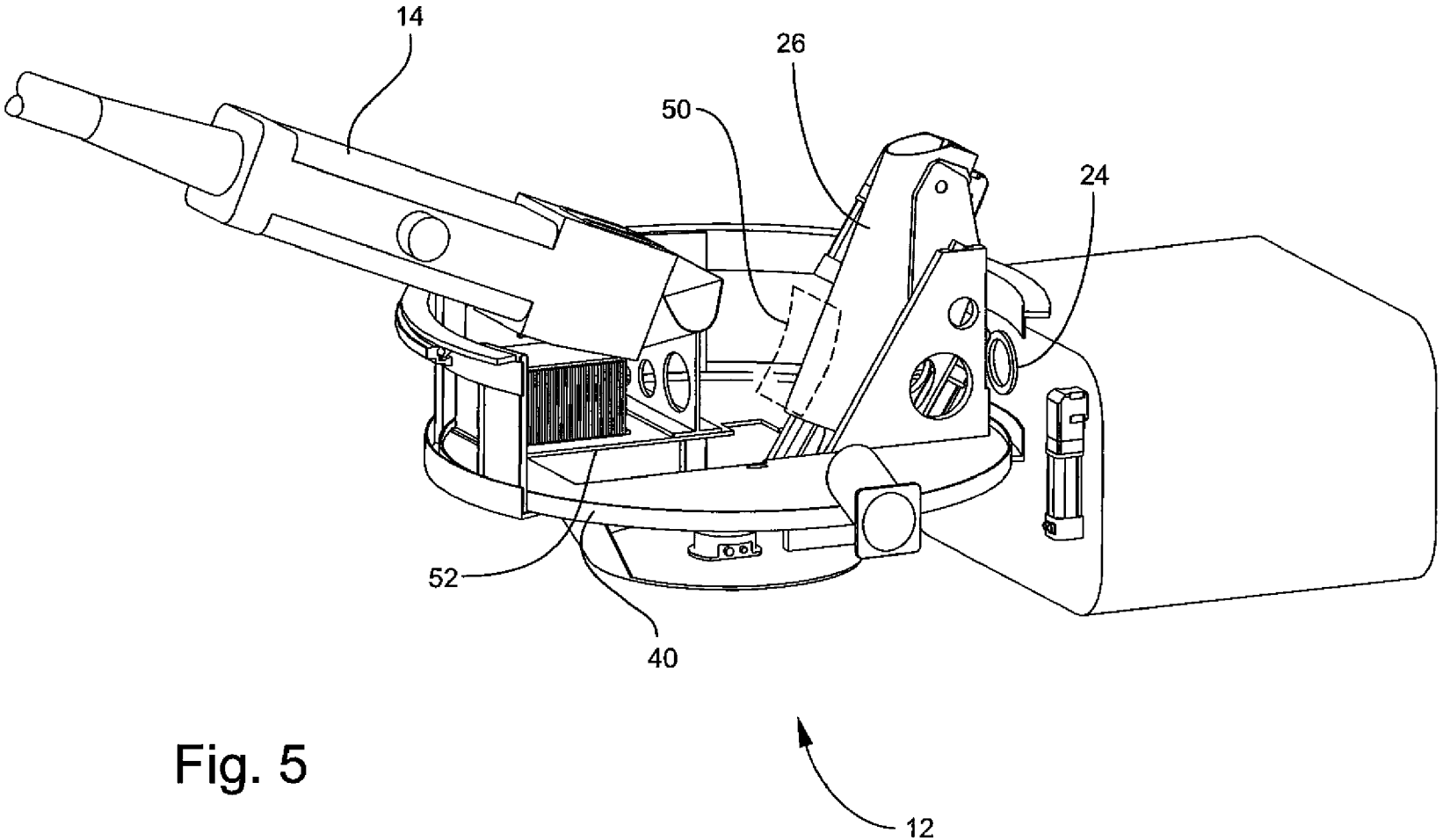
FIG. 5 is a partially cutaway, perspective view of an embodiment of an automatic loader in the stow position.

FIG. 5 shows the autoloader 12 in a stow position, ready for firing. At this time, the gun 14 has been elevated and slewed to its firing position. The transfer device 26 has been repositioned, as shown in FIG. 5, to be clear of the gun recoil zone 50. A cutout 52 in the turntable 40 may allow for recoil at higher gun elevations.

Figure 6:
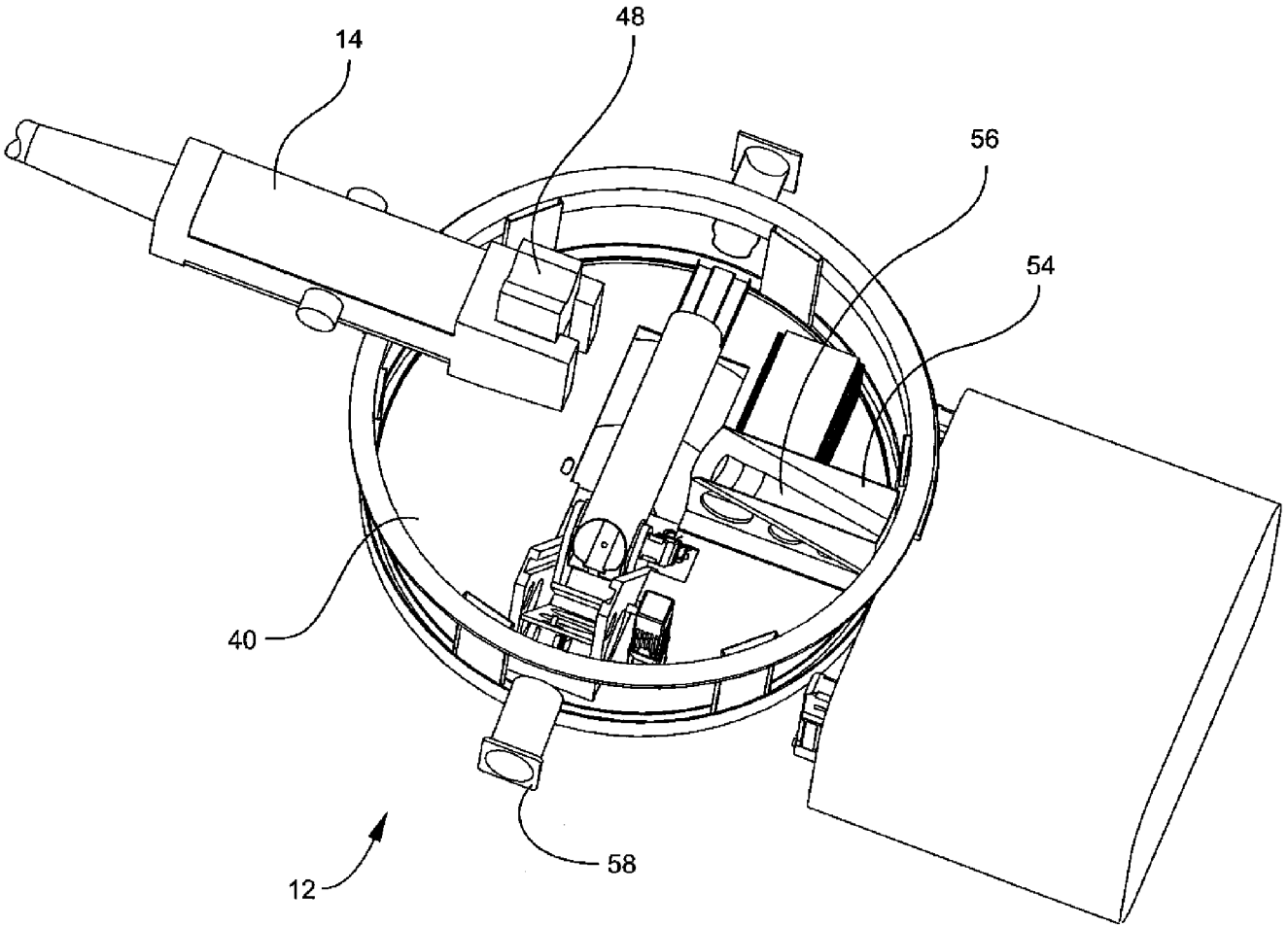
FIG. 6 is a perspective view, from above, of an embodiment of an automatic loader in the case-catch position.

Subsequent to firing, the spent cartridge case must be removed. Referring to FIG. 6, a case catcher 54 may be attached to the turntable 40. In FIG. 6, the turntable 40 has been rotated from its prior position, at firing, to horizontally align the case catcher 54 with the plane of the gun 14. Now, the breech 48 may be opened and the cartridge case 56 may be forcefully ejected by the extractors (not shown) into the case catcher 54. The turntable 40 may now rotate back to the re-arm position to begin the next cycle.

Referring now to FIG. 3, with the turntable 40 positioned for re-arm, the case catcher 54 may simultaneously be aligned with an eject port 58. The eject port 58 may be fixed to the vehicle hull 10 (FIG. 1). The spent cartridge 56 may leave the case catcher 54 and be ejected through the eject port 58.

Figure 7:
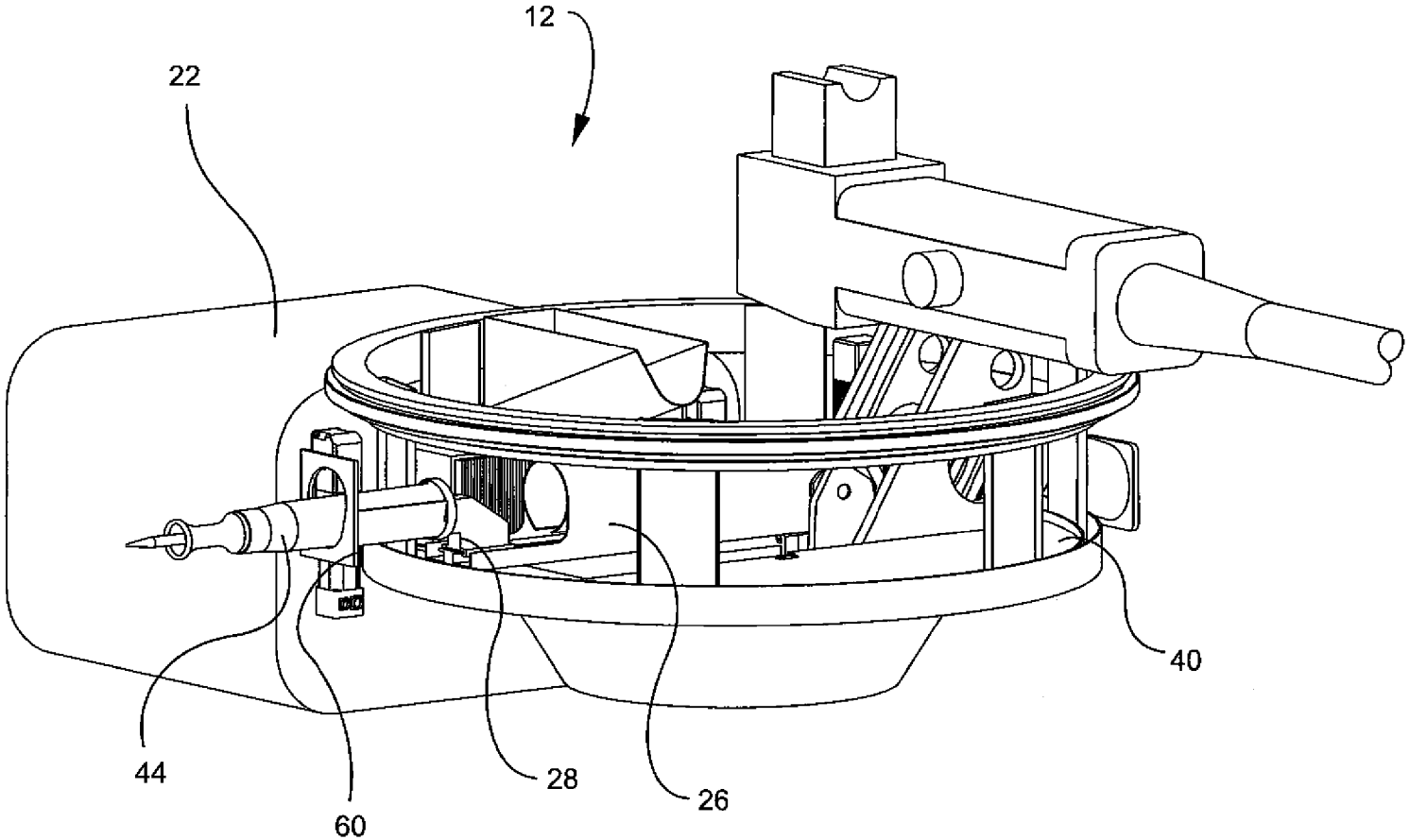
FIG. 7 is a perspective view of an embodiment of an automatic loader in the re-supply position.

The autoloader 12 may also automatically re-stock the magazine 22 with ammunition. Or, the autoloader 12 may remove all remaining ammunition from the magazine 22. Referring now to FIG. 7, a cartridge 44 may be manually inserted into an upload port 60 at the side of the vehicle hull 10. The gripper 28, now aligned with the upload port 60, may capture the round 44 and withdraw the round 44 into the transfer device 26. The turntable 40 may then rotate to align the transfer device 26 with the magazine port 24 (FIG. 3). The round 44 may then be inserted in the magazine port 24. The magazine 22 may then index to provide space for the next round 44, while the transfer device 26 may return to the upload port 60, to repeat the cycle.

Referring now to FIG. 5, it may be seen that the allowable recoil stroke or gun recoil zone 50 of the gun 14 may be limited by the presence of the transfer device 26. To accommodate guns having longer recoil strokes, an alternate embodiment of an autoloader 110 is shown in FIGS. 8 and 9.

Figure 8:
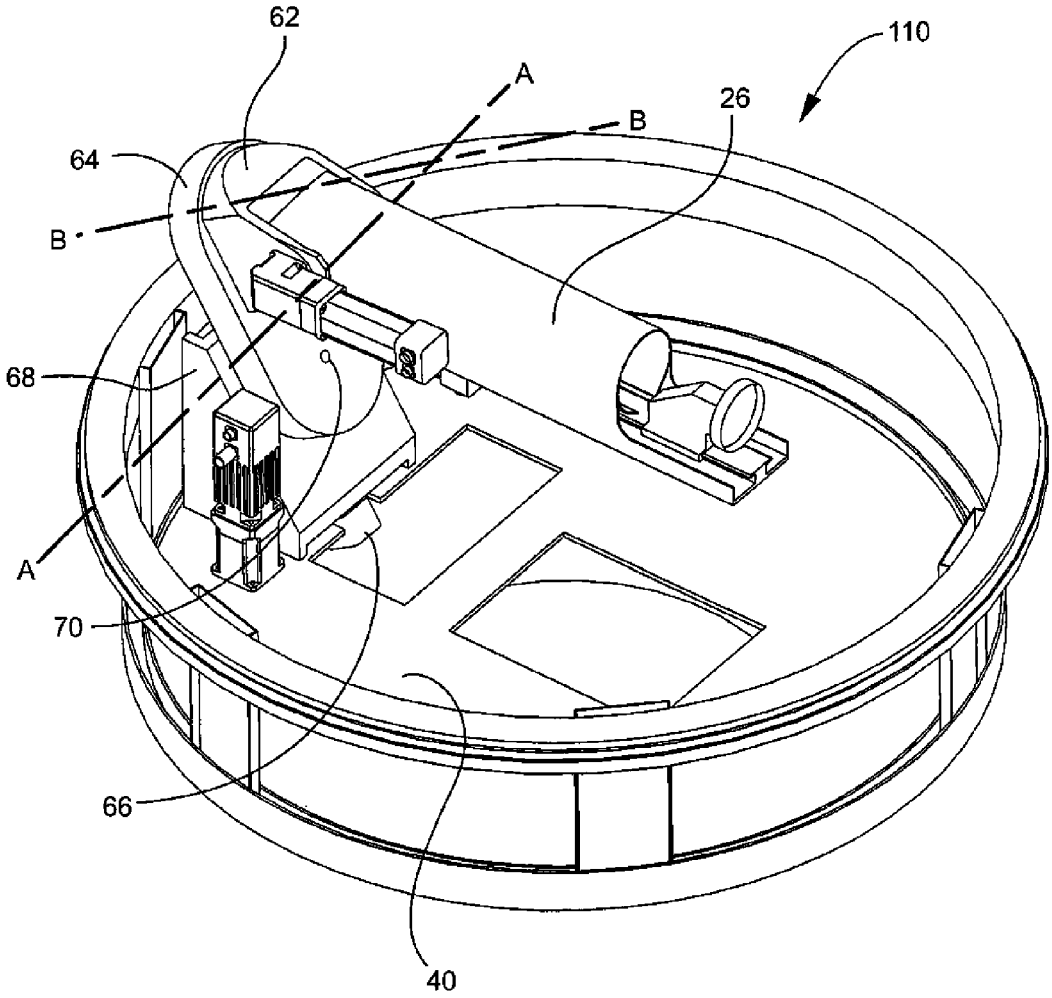
FIG. 8 is a perspective view of an alternative embodiment of an automatic loader, showing its major functional components.

Referring to FIG. 8, an autoloader 110 may include a transfer device 26, as heretofore described. Transfer device 26 may be rotatably mounted on a yoke 62. For example, transfer device 26 may rotate about axis A-A. The yoke 62 may be rotatably mounted to a crank case 64. For example, the yoke 62 may rotate about axis B-B. A servomotor 66 may be mounted to a base 68 that is fixed for rotation with the turntable 40. Servomotor 66 may rotate the crank case 64 relative to the base 68 via a shaft 70.

Figure 9:
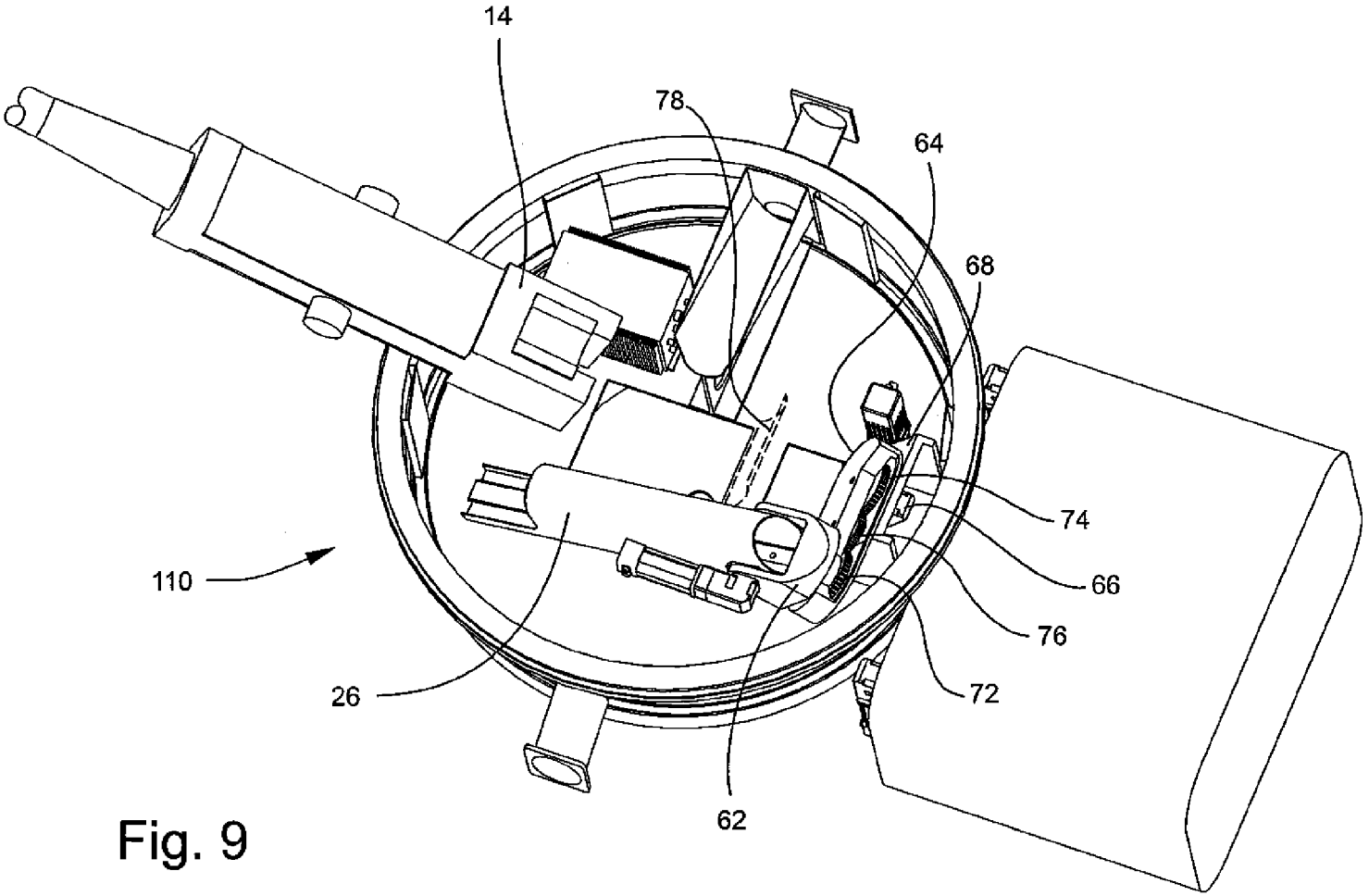
FIG. 9 is a partially cutaway, perspective view of the embodiment of FIG. 8, in the stow position.

Referring now to FIG. 9, autoloader 110 may include a first gear 72 that is fixed to and rotatable with yoke 62. A second gear 74, the same size or similar in size to the first gear 72, may be fixed to the base 68. First gear 72 may be linked to second gear 74 via an intermediate gear 76. Intermediate gear 76 may be mounted in the crank case 64 and may mesh with the first gear 72 and the second gear 74.

When the crank case 64 is rotated by servomotor 66 in a clockwise direction, for example, the interaction of the first gear 72, the second gear 74, and the intermediate gear 76 may cause the yoke 62 to rotate in the opposite, counter-clockwise direction. Thus, the transfer device 26 may remain horizontally oriented throughout the rotation of the crank case 64. In the position shown in FIG. 9, the transfer device 26 is positioned outside of the recoil zone 78 of the gun 14.

The other functional positions of the transfer device 26 that were described with reference to the autoloader 12 may also be achieved with the autoloader 110.

Because the autoloader of the invention does not require that "ready rounds" be stored in the turret, the turret may have less swept volume than autoloaders that include "ready rounds." In addition, the basket may be moved easier than known turrets because it is significantly lighter and of lower inertia than known turrets.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An autoloader, comprising:

a rotatable turntable;

an elevator that rotates with the turntable, the elevator including a track;

a carriage that is linearly translatable on the track of the elevator in directions toward and away from a plane of the turntable; and a transfer device rotatably fixed to a pivot of the carriage, the transfer device including a rail and a gripper that is linearly translatable on the rail.

2. The autoloader of claim 1, further comprising a servomotor for rotating the transfer device around the pivot of the carriage.

3. The autoloader of claim 2, further comprising a motor for rotating the turntable.

4. The autoloader of claim 1, further comprising a cutout portion in the turntable.

5. The autoloader of claim 1, further comprising a case catcher that rotates with the turntable.

6. An apparatus, comprising:

a vehicle hull having a rotatable turret ring;

a basket depending from and rotatable with the turret ring; and the autoloader of claim 1 disposed in the basket, wherein the turntable of the autoloader rotates independent of the turret ring.

7. The apparatus of claim 6, further comprising an ammunition magazine disposed in the vehicle hull, the ammunition magazine including an access port.

8. The apparatus of claim 7, further comprising a gun rotatable with the turret ring.

9. The apparatus of claim 8, wherein, in a re-arm position, the transfer device is aligned with the access port of the ammunition magazine.

10. The apparatus of claim 8, wherein, in a load position, the transfer device is aligned with the gun.

11. The apparatus of claim 8, wherein the autoloader includes a case catcher that rotates with the turntable.

12. The apparatus of claim 8, further comprising an eject port located adjacent the turret ring.

13. The apparatus of claim 12, wherein, in a re-arm position, the transfer device is aligned with the access port of the ammunition magazine and the case catcher is aligned with the eject port.

14. The apparatus of claim 8, further comprising an upload port adjacent the turret ring.

* * * * *